US008550655B1

(12) United States Patent
Wang

(10) Patent No.: US 8,550,655 B1
(45) Date of Patent: Oct. 8, 2013

(54) OMNI-DIRECTIONAL LIGHT RADIATION LAMP AND ILLUMINATION SYSTEM

(75) Inventor: Yu-Nan Wang, Taoyuan County (TW)

(73) Assignees: Jacky Chang, Taoyuan, Taoyuan County (TW); Yu-Nan Wang, Bade, Taoyuan County (TW)

( * ) Notice: Subject to any disclaimer, the term of this patent is extended or adjusted under 35 U.S.C. 154(b) by 8 days.

(21) Appl. No.: 13/431,013

(22) Filed: Mar. 27, 2012

(51) Int. Cl.
*F21V 33/00* (2006.01)

(52) U.S. Cl.
USPC ..... 362/216; 362/249.02; 362/254

(58) Field of Classification Search
USPC ..... 362/216, 249.02, 311.02, 254, 800
See application file for complete search history.

(56) References Cited

U.S. PATENT DOCUMENTS

| | | | | |
|---|---|---|---|---|
| 7,784,967 | B2 * | 8/2010 | Lodhie | 362/249.06 |
| 7,891,835 | B2 * | 2/2011 | Wilcox | 362/245 |
| 8,052,313 | B2 * | 11/2011 | Sassoon | 362/545 |
| 2011/0163678 | A1 * | 7/2011 | Shew | 315/159 |

* cited by examiner

*Primary Examiner* — Laura Tso
(74) *Attorney, Agent, or Firm* — Muncy, Geissler, Olds & Lowe, PLLC

(57) ABSTRACT

An omni-directional light radiation lamp and an omni-directional light radiation illumination system are applied in a standard lamp socket that supplies standard utility power. The omni-directional light radiation lamp includes a base, a circular lamp body, a support module and an annular lamp cover. The base has a plurality of electrode plates, and the circular lamp body has a plurality of omni-directional light emitting diodes, and the omni-directional light emitting diodes are coupled to the electrode plate, and the support module is disposed on the base for carrying the circular lamp body, and the circular lamp cover is covered on the circular lamp body. Several omni-directional light radiation lamps can be stacked and connected in series with one another to selectively adjust the illumination brightness, or further combined with a power controller to perform a smart illumination control of the lamp.

16 Claims, 5 Drawing Sheets

OMNI-DIRECTIONAL LIGHT RADIATION LAMP AND ILLUMINATION SYSTEM

FIELD OF THE INVENTION

The present invention relates to a lamp and an illumination system, in particular to the omni-directional light radiation lamp and the omni-directional light radiation illumination system that can stack and combine the omni-directional light radiation lamps to meet a user's requirement of illumination brightness and perform a smart brightness adjustment of the lamp by using use a power controller.

BACKGROUND OF THE INVENTION

In recent years, green optoelectronic industry blooms. As the light emitting performance of light emitting diodes is enhanced significantly, the light emitting diodes gradually replace conventional light bulbs and serve as novel green illumination lamps. Particularly, high-directionality and high-power light emitting diodes become increasingly popular and are used extensively in different areas.

However, the light emitting diodes generate a large quantity of heat in the high-power light emission, so that the green illumination lamps with the light emitting diodes require a large-area heat dissipation structure to dissipate the generated heat, but such large heat dissipation structure imposes a substantial limitation on the design of the green illumination lamp.

Therefore, the present invention provides an omni-directional light radiation lamp and an omni-directional light radiation illumination system to overcome the drawbacks of the prior art.

SUMMARY OF THE INVENTION

It is a primary objective of the present invention to provide an omni-directional light radiation lamp connectable to a standard lamp socket that supplies standard utility power.

Another objective of the present invention is to stack several of the aforementioned lamps to achieve the effect of adjusting the brightness by a user according to the user's illumination requirement.

Another objective of the present invention is to add a control unit and a wireless communication unit to the aforementioned lamp, wherein the power controller is provided for performing a wireless smart brightness control of the lamp.

Another objective of the present invention is to add a thermoelectric conversion layer and/or a solar conversion layer to the aforementioned lamp for converting heat energy and light energy produced by the lamp into electric energy for the use by the lamp.

Another objective of the present invention is to stack and combine a plurality of omni-directional radiation illumination systems by users to achieve the effect of adjusting the required illumination brightness flexibly.

To achieve the aforementioned and other objectives, the present invention provides an omni-directional radiation lamp applied to a standard lamp socket that supplies standard utility power. The omni-directional radiation lamp comprises a base, a circular lamp body, a support module and an annular lamp cover. Wherein, the base has a plurality of electrode plates; the circular lamp body has a plurality of omni-directional light emitting diodes electrically coupled to one another by a series circuit and separated with a distance apart from one another, and the omni-directional light emitting diodes are coupled to the electrode plate; the support module is comprised of a plurality of support pillars, a support ring and a carrying platform, and an end of each of the support pillars is disposed at the base, and the other end of each of the support pillars is disposed at the support ring, and the support pillars are separated by an angle through the base and the support ring; the carrying platform is disposed at the external periphery of the support ring for carrying the circular lamp body; and the annular lamp cover forms a containing space and is installed at the support ring for disposing the carrying platform in the containing space.

To achieve the aforementioned and other objectives, the present invention further provides an omni-directional radiation illumination system comprising a plurality of omni-directional light radiation lamps and power supply modules. Wherein, each of the omni-directional light radiation lamps comprises a base, a circular lamp body, a support module and an annular lamp cover. Wherein, the base has a plurality of electrode plates; the circular lamp body has a plurality of omni-directional light emitting diodes electrically coupled to one another by a series circuit, and the omni-directional light emitting diodes are separated with a distance apart from one another, and the omni-directional light emitting diodes are coupled to the electrode plate; the support module is comprised of a plurality of support pillars, a support ring and a carrying platform, and an end of each of the support pillars is disposed at the base, and the other end of each of the support pillars is disposed at the support ring, and the support pillars are separated from each other by an angle through the base and the support ring, and the carrying platform is disposed at the external periphery of the support ring for carrying the circular lamp body; and the annular lamp cover forms a containing space and is installed at the support ring for disposing the carrying platform in the containing space; the power supply module is electrically coupled to the omni-directional light radiation lamps, and the power supply module is coupled to a standard lamp socket that supplies standard utility power in order to supply electric energy required by the omni-directional light radiation lamps. The power supply module further includes an electric connection unit and a voltage conversion unit, and the power supply module is coupled to the base, and the electric connection unit is coupled to the standard lamp socket, and the voltage conversion unit is coupled to the electrode plates.

Compared with the prior art, the omni-directional light radiation lamp and illumination system of the present invention assemble the low-power omni-directional packaged light emitting diodes into a 3D light emitting source with low heat source and omni-directionality, and then transparent support module and annular lamp cover are combined to produce a light radiation with an angle coverage of 360 degrees. In addition, the present invention converts the heat energy and light energy produced by the lamp body and/or an external light source into electric energy by the thermoelectric conversion layer and the solar conversion layer so as to drive another omni-directional light radiation lamp to increase its light intensity. The present invention further provides a power controller to control the lamp body in order to achieve a smart illumination control and a power saving effect of the lamp. The electric power required by the power controller can come from a power source with the electric energy converted by the thermoelectric conversion layer and the solar conversion layer.

DETAILED DESCRIPTION OF THE PREFERRED EMBODIMENTS

The objects, characteristics and effects of the present invention will become apparent with the detailed description of the preferred embodiments and the illustration of related drawings as follows.

Figure 1:
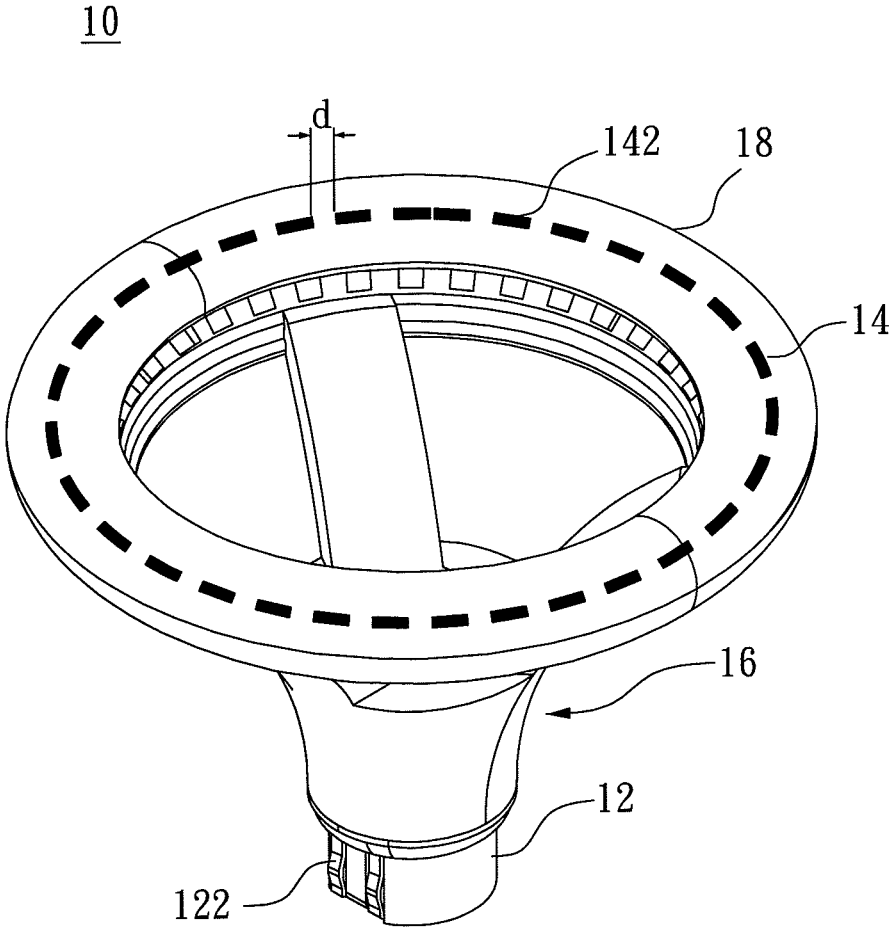
FIG. 1 is a schematic structural view of an omni-directional light radiation lamp in accordance with a first preferred embodiment of the present invention.

With reference to FIG. 1 for a schematic structural view of an omni-directional light radiation lamp in accordance with the first preferred embodiment of the present invention the present invention, the omni-directional light radiation lamp 10 is applied to a standard lamp socket that supplies standard utility power. Wherein, the omni-directional light radiation lamp 10 comprises a base 12, a circular lamp body 14, a support module 16 and an annular lamp cover 18.

The base 12 has a plurality of electrode plates 122, wherein the base 12 of this preferred embodiment is a hollow cone, and the hollow cone is provided for stacking and combining a plurality of omni-directional light radiation lamps. When the omni-directional light radiation lamps are stacked and combined, the electrode plates 122 of the omni-directional light radiation lamps in the base are electrically coupled to one another.

The circular lamp body 14 is comprised of a plurality of omni-directional light emitting diodes 142. Wherein, the omni-directional light emitting diodes 142 are electrically connected by a series circuit, and the omni-directional light emitting diodes 142 are separated with a distance d apart from one another, and the omni-directional light emitting diodes 142 are coupled to the electrode plate 122. In ad preferred embodiment, the omni-directional light emitting diodes 142 are arranged equidistantly on the circumference of the circular lamp body 14. In addition, the omni-directional light emitting diodes 142 form a point light source of a light radiation with an angle coverage of 360 degrees.

Figure 2:
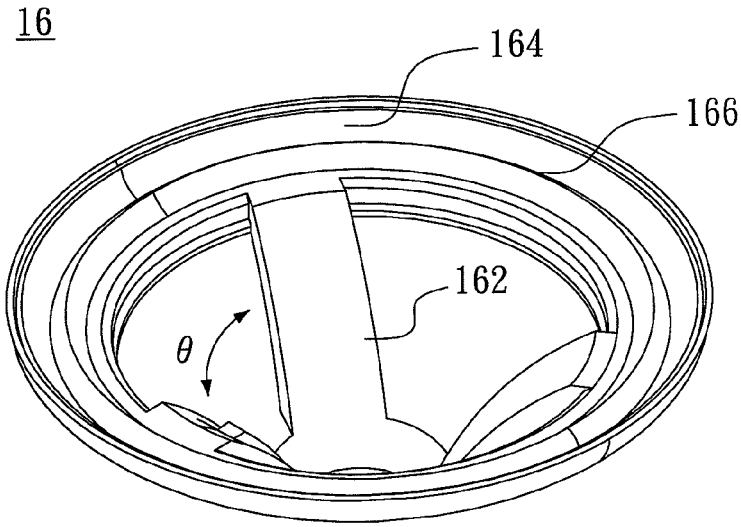
FIG. 2 is a schematic structural view of a circular lamp body as depicted in FIG. 1.

The support module 16 is comprised of a plurality of support pillars 162, a support ring 164 and a carrying platform 166. An end of each support pillar 162 is disposed at the base 12, and the other end of each support pillar 162 is disposed at the support ring 164. The support pillars 162 are separated by an angle θ through the base 12 and the support ring 164. The carrying platform 166 is disposed at the external periphery of the support ring 164 for carrying the circular lamp body 14 as shown in FIG. 2.

In this preferred embodiment, three support pillars 162 are used, and the angle θ that separates the support pillars 162 is equal to 120 degrees. Wherein, the support pillars 162, the support ring 164 and the carrying platform 166 are made of a transparent, translucent or opaque blasted glass material. In addition, the support ring 164 has a radius greater than the radius of the base 12, so that the support pillars 162 can be coupled to the base 12 and the support ring 164 with an arc.

Figure 3:
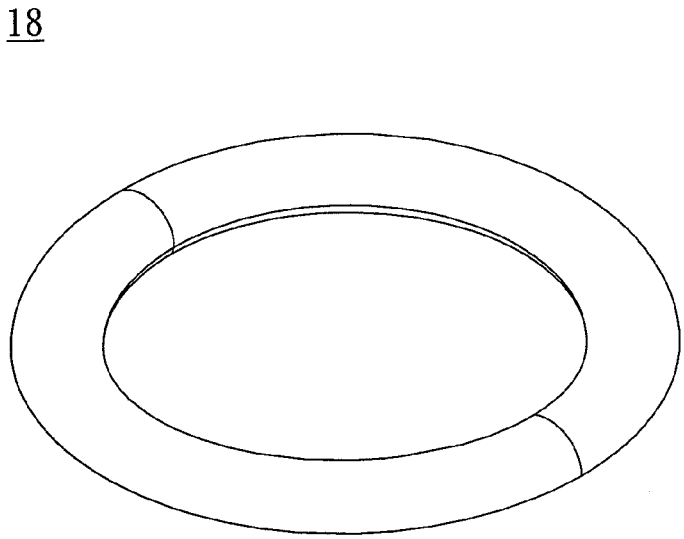
FIG. 3 is a schematic structural view of a support pillar as depicted in FIG. 1.

The annular lamp cover 18 forms a containing space 182, and the circular lamp cover 18 is mounted onto the support ring 164 for containing the carrying platform 166 in the containing space 182 as shown in FIG. 3. Wherein, the circular lamp cover 18 is made of a transparent, translucent or opaque blasted glass material.

Figure 4:
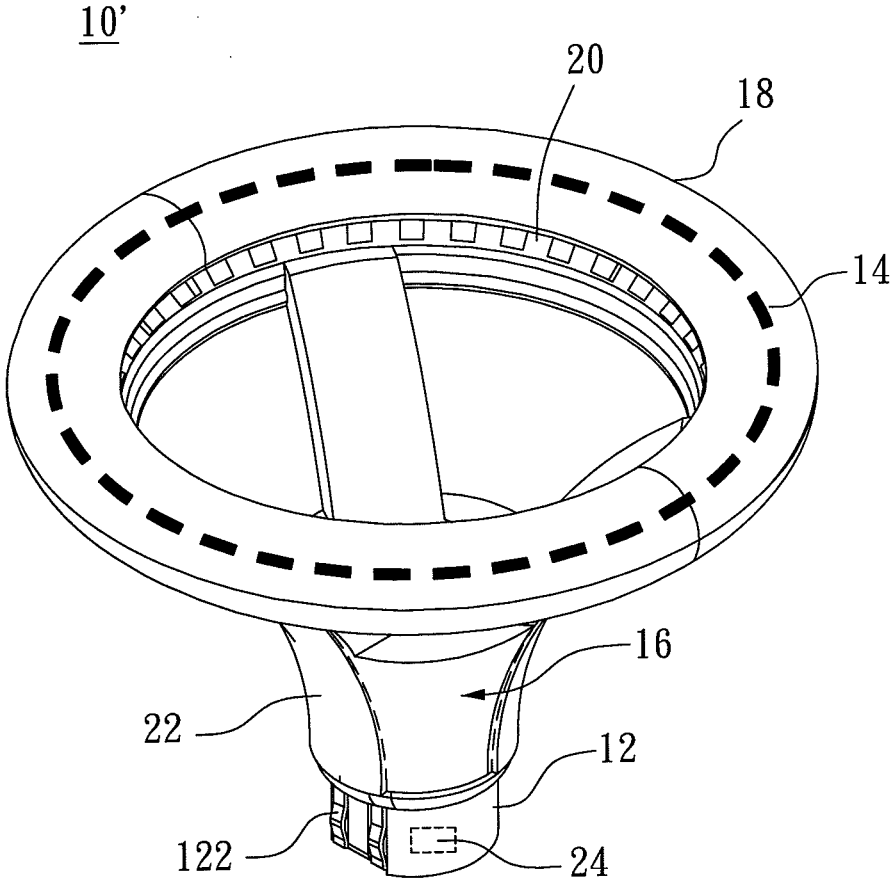
FIG. 4 is a schematic structural view of an omni-directional light radiation lamp in accordance with a second preferred embodiment of the present invention.

With reference to FIG. 4 for a schematic structural view of an omni-directional light radiation lamp in accordance with the second preferred embodiment of the present invention, the omni-directional light radiation lamp 10' also comprises the base 12, the circular lamp body 14, the support module 16 and the annular lamp cover 18, and the difference between this preferred embodiment and the previous preferred embodiment resides on that the omni-directional light radiation lamp 10' further comprises a thermoelectric conversion layer 20, a solar conversion layer 22 and an energy storage unit 24.

The thermoelectric conversion layer 20 is disposed between the circular lamp body 14 and the carrying platform 166 and used for converting heat energy generated by the circular lamp body 14 into electric energy. For example, the thermoelectric conversion layer 20 is a film thermoelectric generator with the Seebeck effect. The solar conversion layer 22 is disposed on the base 12 and/or the support pillars 162 and used for converting light energy radiated from the omni-directional light emitting diodes 142 into electric energy. For example, the solar conversion layer 22 is a film solar cell, a spherical micro solar cell or a paper battery. The energy storage unit 24 is coupled to the thermoelectric conversion layer 20 and the solar conversion layer 22 for storing the electric energy.

Figure 5:
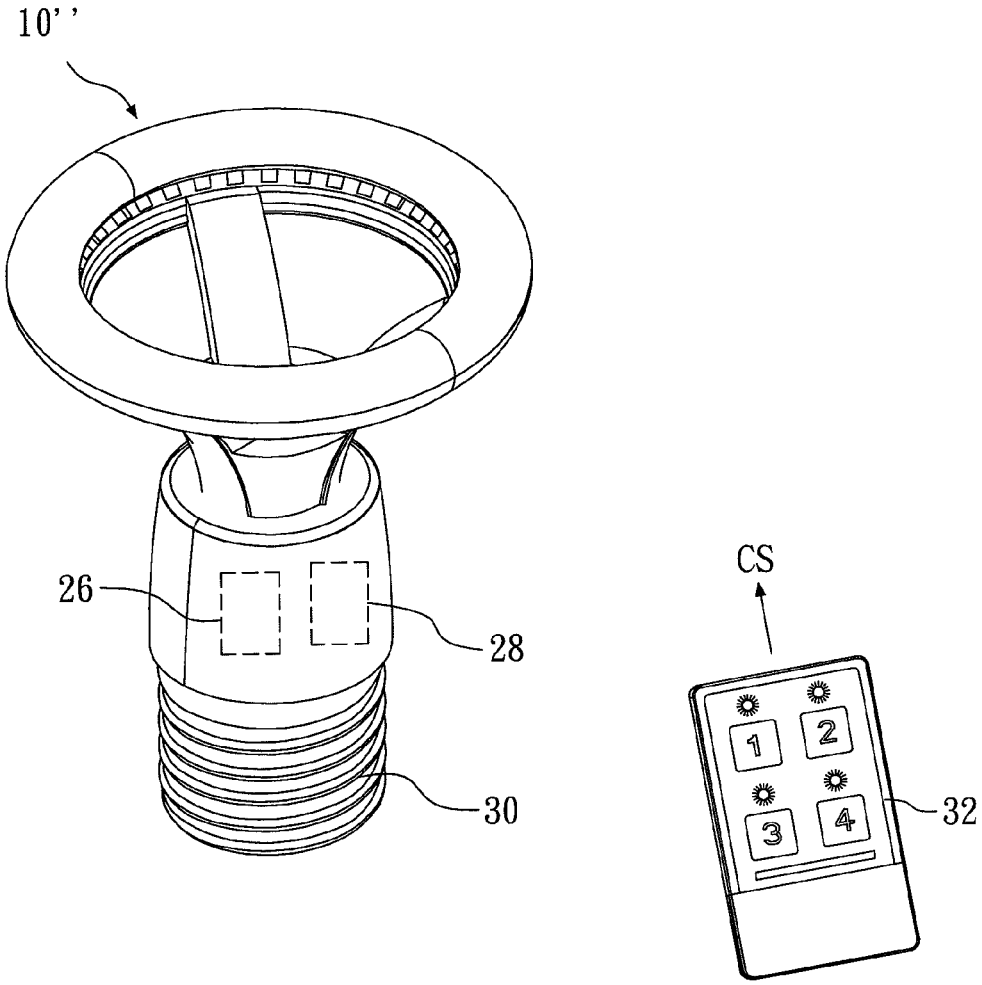
FIG. 5 is a schematic structural view of an omni-directional light radiation lamp in accordance with a third preferred embodiment of the present invention.

With reference to FIG. 5 for a schematic structural view of an omni-directional light radiation lamp in accordance with the third preferred embodiment of the present invention, the omni-directional light radiation lamp 10" also comprises the base 12, the circular lamp body 14, the support module 16, the annular lamp cover 18, the thermoelectric conversion layer 20, the solar conversion layer 22 and the energy storage unit 24, and the difference between this preferred embodiment and the previous preferred embodiment resides on that the omni-directional light radiation lamp 10" further comprises a control unit 26, a wireless communication unit 28, a power supply module 30 and a power controller 32.

The control unit 26 and the wireless communication unit 28 are coupled to the energy storage unit 24 for using the electric energy. Wherein, the wireless communication unit 28 is provided for receiving a control signal CS from the power controller 32 and the control unit 26 adjusts the brightness of the omni-directional light emitting diodes 142 and controls the omni-directional light emitting diodes 142 to enter into an ON or OFF state according to the control signal CS.

The power supply module 30 further comprises an electric connection unit and a voltage conversion unit, and the power supply module 30 is coupled to the base 12, and the electric connection unit is provided for connecting the standard lamp socket, and the voltage conversion unit is coupled to the electrode plates 122.

The power controller 32 is provided for generating the control signal CS to adjust the brightness of the omni-directional light emitting diodes 142 and controls the ON/OFF state.

Figure 6:
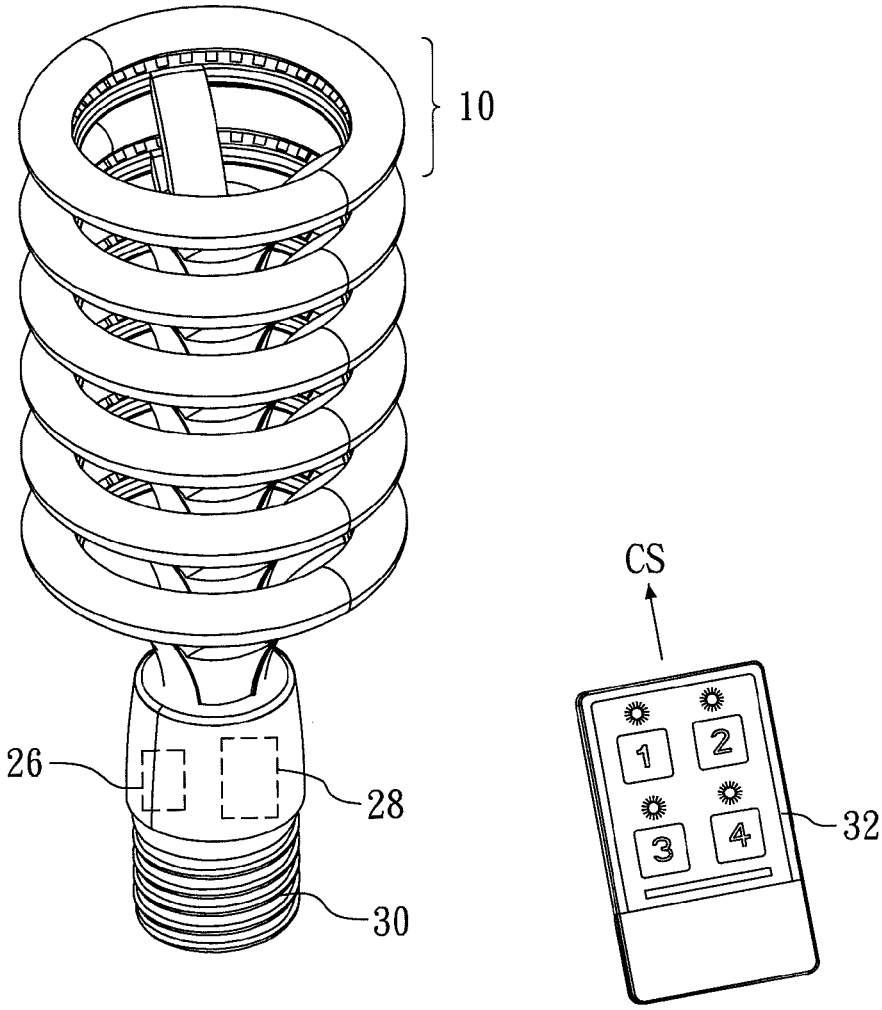
FIG. 6 is a schematic system view of an omni-directional radiation illumination system in accordance with a preferred embodiment of the present invention.

With reference to FIG. 6 for a schematic system view of an omni-directional radiation illumination system in accordance with a preferred embodiment of the present invention, the omni-directional radiation illumination system 40 comprises a plurality of the aforementioned omni-directional light radiation lamps 10 and a power supply module 30. Wherein, several omni-directional light radiation lamp 10 can be stacked and combined, and the power supply module 30 is electrically coupled to the omni-directional light radiation lamps 10, and the power supply module 30 is combined with a standard lamp socket that supplies standard utility power in order to supply electric energy required by the omni-directional light radiation lamps 10.

In addition, the omni-directional radiation illumination system 40 further comprises the control unit 26, the wireless communication unit 28 and the energy storage unit 24, and these units 16, 28, 24 are installed in the power supply module 30. Wherein, the wireless communication unit 28 is provided for receiving a control signal CS from the power controller 32 and the control unit 26 adjusts the brightness of the omni-directional light emitting diodes 142 and controls the omni-directional light emitting diodes 142 to enter into an ON or OFF state according to the control signal CS. The control signal CS generated by the power controller 32 is received to control the omni-directional light emitting diodes 142 to enter into an ON or OFF state.

Therefore, the omni-directional light radiation lamp and illumination system in accordance with the present invention assemble the low-power omni-directional packaged light emitting diodes into a 3D light emitting source with low heat source and omni-directionality, and then transparent support module and annular lamp cover are combined to produce a light radiation with an angle coverage of 360 degrees. In addition, the present invention converts the heat energy and light energy produced by the lamp body and/or an external light source into electric energy by the thermoelectric conversion layer and the solar conversion layer, so as to drive another omni-directional light radiation lamp to increase its light intensity. The present invention further provides a power controller to control the lamp body in order to achieve a smart illumination control and a power saving effect of the lamp. The electric power required by the power controller can come from a power source with the electric energy converted by the thermoelectric conversion layer and the solar conversion layer.

While the invention has been described by means of specific embodiments, numerous modifications and variations could be made thereto by those skilled in the art without departing from the scope and spirit of the invention set forth in the claims.

What is claimed is:

1. An omni-directional light radiation lamp, applied to a standard lamp socket that supplies standard utility power, comprising:

a base, having a plurality of electrode plates;

a circular lamp body, having a plurality of omni-directional light emitting diodes electrically coupled to one another by a series circuit and separated with a distance apart from one another, and the omni-directional light emitting diodes being coupled to the electrode plate;

a support module, comprised of a plurality of support pillars, a support ring and a carrying platform, and an end of each of the support pillars being disposed at the base, and the other end of each of the support pillars being disposed at the support ring, and the support pillars being separated by an angle through the base and the support ring, and the carrying platform being disposed at the external periphery of the support ring for carrying the circular lamp body; and an annular lamp cover, forming a containing space, and being installed at the support ring for disposing the carrying platform in the containing space.

2. The omni-directional light radiation lamp of claim 1, further comprising a thermoelectric conversion layer disposed between the circular lamp body and the carrying platform for converting heat energy generated by the circular lamp body into electric energy.

3. The omni-directional light radiation lamp of claim 2, wherein the thermoelectric conversion layer is a film thermoelectric generator with the Seebeck effect.

4. The omni-directional light radiation lamp of claim 1, further comprising a solar conversion layer disposed on at least one of the base and the support pillars, and the solar conversion layer being provided for converting light energy radiated from the omni-directional light emitting diodes into electric energy.

5. The omni-directional light radiation lamp of claim 4, wherein the solar conversion layer is a film solar cell, a spherical micro solar cell or a paper battery.

6. The omni-directional light radiation lamp of claim 2, further comprising an energy storage unit for storing the electric energy.

7. The omni-directional light radiation lamp of claim 4, further comprising an energy storage unit for storing the electric energy.

8. The omni-directional light radiation lamp of claim 6, further comprising a control unit and a wireless communication unit, both coupled to the energy storage unit, and the wireless communication unit being provided for receiving a control signal, and the control unit being provided for adjusting the brightness of the omni-directional light emitting diodes and controlling the omni-directional light emitting diodes to enter into an ON or OFF state according to the control signal.

9. The omni-directional light radiation lamp of claim 7, further comprising a control unit and a wireless communication unit, both coupled to the energy storage unit, and the wireless communication unit being provided for receiving a control signal, and the control unit being provided for adjusting the brightness of the omni-directional light emitting diodes and controlling the omni-directional light emitting diodes to enter into an ON or OFF state according to the control signal.

10. The omni-directional light radiation lamp of claim 8, further comprising a power controller provided for generating the control signal, and connecting to the wireless communication unit through a wireless communication technology to transmit the control signal to the wireless communication unit.

11. The omni-directional light radiation lamp of claim 9, further comprising a power controller provided for generating the control signal, and connecting to the wireless communication unit through a wireless communication technology to transmit the control signal to the wireless communication unit.

12. The omni-directional light radiation lamp of claim 1, further comprising a power supply module, having an electric connection unit and a voltage conversion unit, and the power supply module being coupled to the base, and the electric connection unit being coupled to the standard lamp socket, and the voltage conversion unit being coupled to the electrode plates.

13. The omni-directional light radiation lamp of claim 1, wherein the base is a hollow cone, and after the electrode plates are installed in the hollow cone and stacked and combined with the plurality of bases, the electrode plates are electrically coupled to one another.

14. An omni-directional radiation illumination system, comprising:

a plurality of omni-directional light radiation lamps, each comprising:

a base, having a plurality of electrode plates;

a circular lamp body, having a plurality of omni-directional light emitting diodes electrically coupled to one another by a series circuit, and the omni-directional light emitting diodes being separated with a distance apart from one another, and the omni-directional light emitting diodes being coupled to the electrode plate;

a support module, comprised of a plurality of support pillars, a support ring and a carrying platform, and an end of each of the support pillars being disposed at the base, and the other end of each of the support pillars being disposed at the support ring, and the support pillars being separated from each other by an angle through the base and the support ring, and the carrying platform being disposed at the external periphery of the support ring for carrying the circular lamp body; and an annular lamp cover, forming a containing space, and being installed at the support ring for disposing the carrying platform in the containing space;

a power supply module, electrically coupled to the omni-directional light radiation lamps, and the power supply module being coupled to a standard lamp socket that supplies standard utility power in order to supply electric energy required by the omni-directional light radiation lamps.

15. The omni-directional light radiation lamp of claim 14, further comprising a control unit and a wireless communication unit, and the wireless communication unit being provided for receiving a control signal, and the control unit being provided for adjusting the brightness of the omni-directional light emitting diodes and controlling the omni-directional light emitting diodes to enter into an ON or OFF state according to the control signal.

16. The omni-directional light radiation lamp of claim 15, further comprising a power controller provided for generating the control signal, and connecting to the wireless communication unit through a wireless communication technology to transmit the control signal to the wireless communication unit.

* * * * *